US007535474B1

(12) United States Patent
Scholander et al.

(10) Patent No.: US 7,535,474 B1
(45) Date of Patent: May 19, 2009

(54) SYSTEM AND METHOD FOR ROTATING RASTERIZED IMAGE DATA

(75) Inventors: Kevin A. Scholander, Fort Collins, CO (US); Brett A. Tischler, Longmont, CO (US)

(73) Assignee: Advanced Micro Devices, Inc., Sunnyvale, CA (US)

( * ) Notice: Subject to any disclaimer, the term of this patent is extended or adjusted under 35 U.S.C. 154(b) by 403 days.

(21) Appl. No.: 11/297,857

(22) Filed: Dec. 9, 2005

(51) Int. Cl.
*G09G 5/39* (2006.01)

(52) U.S. Cl. ..... 345/531; 345/649

(58) Field of Classification Search ..... 345/531, 345/649

See application file for complete search history.

(56) References Cited

U.S. PATENT DOCUMENTS 5,822,768 A * 10/1998 Shakkarwar ..... 711/149
5,889,893 A * 3/1999 Robson ..... 382/296
6,031,546 A * 2/2000 Shimizu ..... 345/656
6,301,397 B1 * 10/2001 Jankowski et al. ..... 382/296
6,819,334 B1 * 11/2004 Owada et al. ..... 345/659

* cited by examiner

*Primary Examiner*—Xiao M Wu
*Assistant Examiner*—Edward Martello

(57) ABSTRACT

A method includes logically organizing rasterized image data into a first matrix of pixel tiles and individually rotating each pixel tile so as to generate a corresponding pixel tile of a second matrix representing an orthogonal representation of the first matrix. Each pixel tile represents a set of buffer lines of a frame buffer storing rasterized image data. The pixel tile is rotated by accessing and storing each buffer line of pixel data in a set of tile buffers such that the pixel data for each pixel in the same column position of an adjacent row is stored in a different tile buffer so that the set of tile buffers can be individually accessed to obtain pixel data for a set of pixels in the same column position in adjacent rows. This obtained pixel data is written to a second frame buffer as a row of pixel data for the corresponding pixel tile of the second matrix.

18 Claims, 5 Drawing Sheets

SYSTEM AND METHOD FOR ROTATING RASTERIZED IMAGE DATA

FIELD OF THE DISCLOSURE

The present disclosure relates generally to processing data and more particularly to processing image data for display in different orientations.

BACKGROUND

Most displays (e.g., computer monitors) display images in a landscape mode where the image data is displayed row-by-row, often from left to right, top to bottom. Display systems therefore are conventionally organized to accommodate landscape-mode displays by organizing rasterized image in a frame buffers so that each buffer line of the frame buffer stores data for a corresponding segment of a row of pixels of the image. Accordingly, to display an image on the monitor, the display system accesses each buffer line in sequence and provides the data contents of the buffer line to the display for display as a portion of a row of pixels.

Due to their landscape-oriented frame buffer configuration and due to the buffer-line length access transactions for most frame buffers, it is inefficient to read the data in a landscape-oriented frame buffer vertically so as to output a portrait-oriented image. Accordingly, display systems often must implement considerable effort to convert the display from a landscape orientation to a portrait orientation so that the portrait-oriented image data can be accessed on a buffer line-by-buffer line basis. This conversion typically entails rotating the landscape-oriented rasterized image data in one frame buffer to a portrait orientation in another frame buffer so that a row of pixel data for a row of pixels in the landscape orientation becomes a column of pixel data for the corresponding column of pixels. However, because frame buffers typically are accessed on a buffer line-by-buffer line basis, conventional image rotation techniques typically entail accessing each of the buffer lines of the first frame buffer numerous times to fill in the second frame buffer. Accordingly, an improved technique for rotating rasterized image data would be advantageous.

BRIEF DESCRIPTION OF THE DRAWINGS

The purpose and advantages of the present disclosure will be apparent to those of ordinary skill in the art from the following detailed description in conjunction with the appended drawings in which like reference characters are used to indicate like elements, and in which.

DETAILED DESCRIPTION OF THE DISCLOSURE

Figure 1:
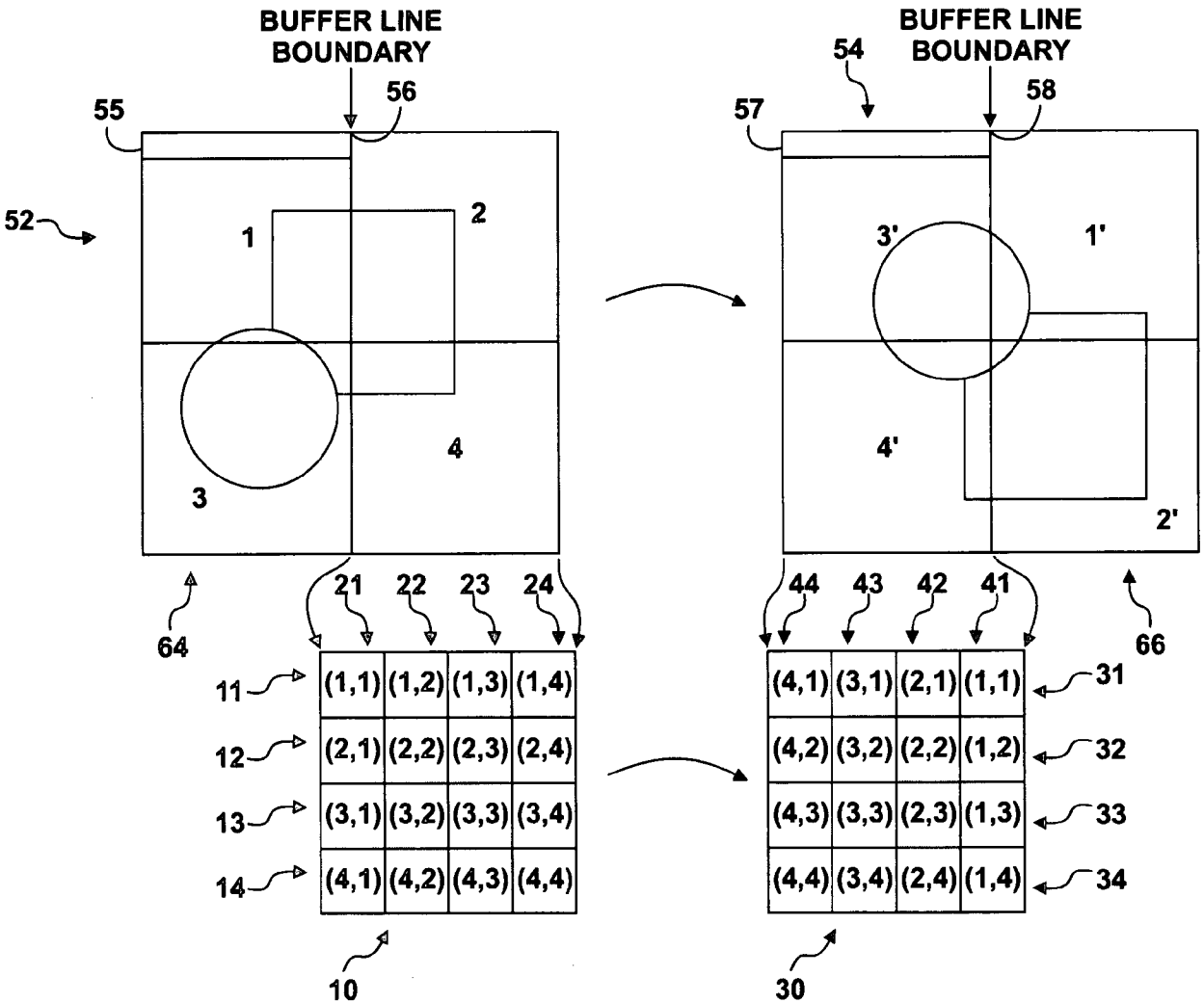
FIG. 1 is a diagram illustrating an exemplary rotation of rasterized image data by individually rotating each pixel tile of a matrix of pixel tiles representative of an image in accordance with at least one embodiment of the present disclosure.

The following description is intended to convey a thorough understanding of the present disclosure by providing a number of specific embodiments and details involving processing and displaying rasterized image data. It is understood, however, that the present disclosure is not limited to these specific embodiments and details, which are exemplary only. It is further understood that one possessing ordinary skill in the art, in light of known systems and methods, would appreciate the use of the disclosure for its intended purposes and benefits in any number of alternative embodiments, depending upon specific design and other needs.

In accordance with one aspect of the present disclosure, a method includes sequentially accessing each buffer line of a first plurality of buffer lines of a first frame buffer having rasterized image data to obtain pixel data at the buffer line. The pixel data at each buffer line of the first plurality of buffer lines represents a corresponding row of N pixels of a first pixel tile of a first matrix of pixel tiles representative of an image in a first orientation. The method also includes storing the pixel data of each buffer line at M separately-accessible tile buffers so that pixel data for each pixel of the buffer line is stored in a different tile buffer and so that pixel data for each pixel of N column-adjacent pixels of the first pixel tile is stored in a different tile buffer than the pixel data for the other pixels of the N column-adjacent pixels, wherein M is greater than or equal to N. The method further includes accessing, for each set of N column-adjacent pixels of the first pixel tile, the M tile buffers substantially simultaneously so as to obtain pixel data for the set of N column-adjacent pixels. The method further comprises storing, for each set of N column-adjacent pixels, the obtained pixel data for the set of N column-adjacent pixels as a corresponding buffer line of a second plurality of buffer lines of a second frame buffer. The pixel data at each buffer line of the second plurality of buffer lines represents a corresponding row of N pixels of a second pixel tile of a second matrix of pixel tiles representative of the image in a second orientation orthogonal to the first orientation.

In accordance with another aspect of the present disclosure, a method includes logically organizing rasterized image data stored at a first frame buffer as a first matrix of first pixel tiles, wherein the first matrix of first pixel tiles is representative of an image in a first orientation and wherein each first pixel tile comprises a plurality of rows, each row comprising pixel data for a row of pixels of a corresponding portion of the image. The method further includes storing the rasterized image data at a second frame buffer, wherein the rasterized image data at the second frame buffer is logically organized as a second matrix of second pixel tiles representative of the image in a second orientation orthogonal to the first orientation, wherein each second pixel tile of the second matrix comprises an orthogonally-rotated representation of a corresponding first pixel tile of the first matrix. The method also includes monitoring write accesses made to the first frame buffer to identify one or more modified first pixel tiles comprising pixel data that has been modified since a first update event. The method additionally includes replacing, for each modified first pixel tile of the one or more modified first pixel tiles, the rasterized image data of the corresponding second pixel tile at the second frame buffer with the rasterized image data of the modified first pixel tile in response to a second update event, wherein the rasterized image data of the modified first pixel tile is orthogonally rotated to replace the rasterized image data of the corresponding second pixel tile.

In accordance with yet another aspect of the present disclosure, a system includes a first frame buffer to store rasterized image data in a first orientation, a second frame buffer to store rasterized image data in a second orientation orthogonal to the first orientation, and M separately-accessible tile buffers. The system further includes a fetch engine operably coupled to the first frame buffer, the fetch engine to sequentially access each buffer line of a first plurality of buffer lines of the first frame buffer to obtain pixel data at the buffer line, wherein the pixel data at each buffer line of the first plurality of buffer lines represents a corresponding row of N pixels of a first pixel tile of a first matrix of pixel tiles representative of an image in the first orientation. The system additionally includes a pixel distribution module operably coupled to the fetch engine and the M tile buffers, the pixel distribution module to store the pixel data of each buffer line at the M tile buffers so that pixel data for each pixel of the buffer line is stored in a different tile buffer and so that pixel data for each pixel of N column-adjacent pixels of the first pixel tile is stored in a different tile buffer than the pixel data for the other pixels of the N column-adjacent pixels, wherein M is greater than or equal to N. The system further includes a repack module operably coupled to the M tile buffers, the repack module to access, for each set of N column-adjacent pixels of the first pixel tile, the M tile buffers substantially simultaneously so as to obtain pixel data for the set of N column-adjacent pixels. The system also includes write engine operably coupled to the repack module and the second frame buffer, the write engine to store, for each set of N column-adjacent pixels, the obtained pixel data for the set of N column-adjacent pixels as a corresponding buffer line of a second plurality of buffer lines of the second frame buffer, wherein the pixel data at each buffer line of the second plurality of buffer lines represents a corresponding row of N pixels of a second pixel tile of a second matrix of pixel tiles representative of the image in the second orientation.

Referring to FIG. 1, a diagram depicting an exemplary rotation of an image from a first orientation to a second orientation is illustrated in accordance with at least one embodiment of the present disclosure. As shown, the frame buffer 64 stores rasterized image data representative of an image in first orientation 52. In this example, the rasterized image data is stored at a plurality of buffer lines 55 organized in two columns, where the pixels of the image are divided horizontally at buffer line boundary 56 between the two columns. As also shown, the plurality of buffer lines 55 are logically organized into a two-by-two pixel tile matrix having pixel tiles 1-4 arranged as illustrated. The term "pixel tile," as used herein, refers to a matrix of adjacent pixels of an image. To illustrate, a 4×4 pixel tile refers to a matrix of pixels four pixels wide and four pixels high. In at least one embodiment, the pixel tiles are square (i.e., their width and depth are the same). Each pixel tile is composed of rows of pixels, where, in one embodiment, the number of pixels in each of the rows corresponds to the number of pixels represented by the image data stored at each of the buffer lines of the frame buffer 64.

The term "column-adjacent pixels," as used herein, is defined as those pixels that occupy the same column position for an identified number of adjacent rows of pixels. To illustrate, assume a matrix of four rows (rows 1-4) and four columns (columns 1-4) and identified by (row, column) as represented by Table 1. In the illustrated matrix, pixels (1,1), (2,1), (3,1) and (4,1) are four column-adjacent pixels because they occupy the column 1 position of four adjacent rows (i.e., rows 1-4, respectively). Pixels (1,2), (2,2), (3,2) and (4,2) likewise are four column-adjacent pixels because they occupy the column 2 position of four adjacent rows (i.e., rows 1-4, respectively). As another example, pixels (2,4) and (3,4) are two column-adjacent pixels because they occupy the column 4 position of two adjacent rows (i.e., rows 2 and 3, respectively).

TABLE 1

| 4 × 4 Pixel Matrix | | | |
|---|---|---|---|
| (1, 1) | (1, 2) | (1, 3) | (1, 4) |
| (2, 1) | (2, 2) | (2, 3) | (2, 4) |
| (3, 1) | (3, 2) | (3, 3) | (3, 4) |
| (4, 1) | (4, 2) | (4, 3) | (4, 4) |

A matrix of pixel tiles (or pixel tile matrix) is a grouping of adjacent pixel tiles. To illustrate, the image in the first orientation 52 is organized into a 2×2 matrix of pixel tiles (i.e., pixel tiles 1, 2, 3 and 4). In at least one embodiment, each pixel tile of a pixel tile matrix is distinct from the other pixel tiles of the matrix (i.e., no two pixel tiles of a pixel tile matrix share any pixel of the image).

FIG. 1 further illustrates frame buffer 66 as storing the rasterized image data representative of the image in a second orientation 54 that is orthogonal to the first orientation 52. As with the frame buffer 64, the frame buffer 66 stores the rasterized image data at a plurality of buffer lines 57 organized in two columns, where the plurality of buffer lines 57 are organized into a two-by-two pixel tile matrix having pixel tiles 1'-4', where pixel tile 1'-4 correspond to pixel tiles 1-4, respectively.

In the illustrated example, each of the pixel tiles comprises pixel data representative of a square matrix of pixels. To illustrate, pixel tile 4 comprises a matrix of pixel data organized by rows 11-14 and columns 21-24 and pixel tile 4' comprises a matrix of pixel data organized by rows 31-34 and columns 41-44, where rows 31-34 of pixel tile 4' store the pixel data of columns 21-24, respectively, of pixel tile 4 and where columns 41-44 of pixel tile 4' store the pixel data of rows 11-14, respectively. In view of the row-to-column correspondence between the pixel tiles 1-4 and their corresponding pixel tiles 1'-4', each pixel tile of the frame buffer 64 is individually rotated to generate the pixel tile for the frame buffer 66 by reading or otherwise accessing the pixel data of the pixel tile of the frame buffer 64 (i.e., each row of pixel data of the pixel tile) on a buffer line-by-buffer line basis and temporarily storing the pixel data in a plurality of tile buffers. The tile buffers then are accessed so as to obtain the pixel data for N column-adjacent pixels (where N equals the number of pixels represented by a buffer line) and the obtained pixel data is written to the corresponding buffer line of the corresponding pixel tile of the frame buffer 66. As discussed below with respect to FIGS. 3 and 5, in one embodiment, the pixel data for each pixel of N column-adjacent pixels of the pixel tile each is stored in a different tile buffer so as to prevent the situation where two or more accesses to the same tile buffer need to be performed to obtain the pixel data for the N column-adjacent pixels.

Figure 2:
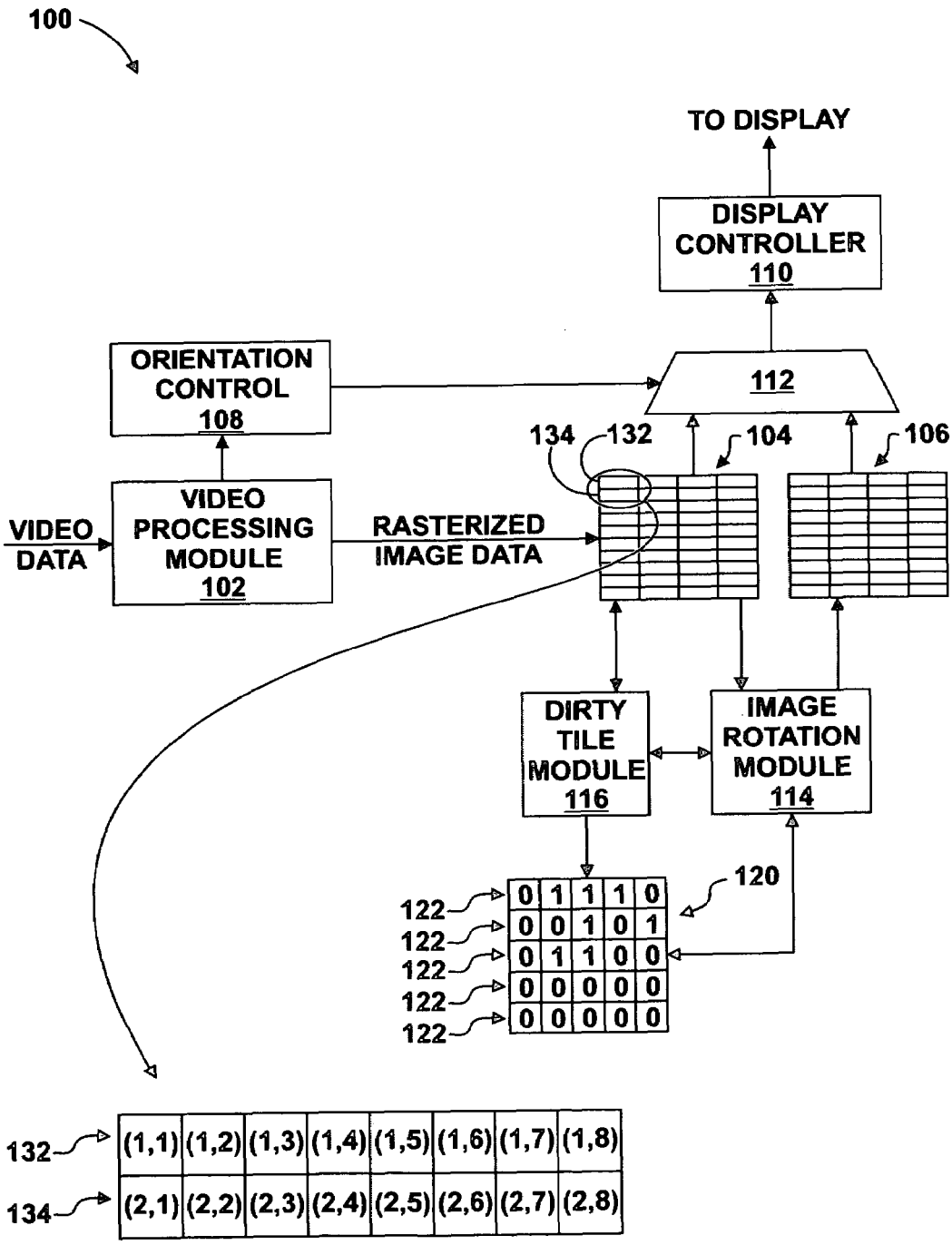
FIG. 2 is a block diagram illustrating an exemplary multiple-orientation display system in accordance with at least one embodiment of the present disclosure.

Referring to FIG. 2, an exemplary multiple-orientation display system 100 is illustrated in accordance with at least one embodiment of the present disclosure. As shown, the display system 100 includes a video processing module 102 having an input to receive video data and an output to provide rasterized image data. The received video data includes information representative of a sequence of one or more images (e.g., a sequential sequence of video frames) and can include encoded data (e.g., motion pictures experts group (MPEG)-encoded data), analog data (e.g., a broadcast television signal or cable television signal), and the like. The video processing module 102 can include, for example, a multimedia processor having video decoding and/or transcoding capabilities.

The system 100 further includes frame buffers 104 and 106 to store rasterized image data in a first orientation and a second orientation, respectively. In one embodiment, the frame buffer 104 and the frame buffer 106 are implemented as separate storage components. In another embodiment, the frame buffer 104 and the frame buffer 106 are implemented as different portions of the same frame buffer. The frame buffers 105 and 106, in one embodiment, are implemented in a unified memory architecture (UMA). The system 100 further includes an orientation control module 108 having an input connected to the video processing module 102, where the orientation control module 108 direct the system 100 during operation in a particular orientation mode (e.g., "landscape" mode or "portrait" mode) by directing rasterized image data from either the frame buffer 104 or the frame buffer 106, depending on orientation mode, to the display controller 110 for further processing and provision to a display device (e.g., a television, a computer monitor, a portable device display screen, and the like).

The access of rasterized image data from a selected one of the frame buffers 104 or 106 is symbolically illustrated as a multiplexer 112 having inputs connected to the frame buffers 104 and 106, a mux select input controlled by the orientation control 108, and an output connected to an input of the display controller 110, where the multiplexer 112 selects one of its inputs for output based on the mux select input. It will be appreciated that this selection mechanism may be implemented as an actual multiplexer, as a memory controller other memory access component that accesses one of the frame buffers 104 or 106 depending on orientation mode, and the like.

The display system 100 further includes an image rotation module 114 and a dirty tile module 116. The image rotation module 114 includes an input connected to the frame buffer 104 and an output connected to the frame buffer 106 connected to the orientation control module 108. The dirty tile module 116 is connected to both the image rotation module 114 and the frame buffer 104 and maintains a dirty pixel tile table 120 based on write accesses performed to the frame buffer 104. For ease of illustration, is assumed that the video processing module 102 is configured to rasterized image data only in a landscape orientation, so the frame buffer 104 is described herein as storing rasterized image data in a landscape orientation and the frame buffer 106 is described as storing the rasterized image data in a portrait orientation. Accordingly, in the exemplary implementation described herein, the image rotation module 114 converts a copy of the rasterized image data at the frame buffer 104 from a landscape orientation to a portrait orientation for storage at the frame buffer 106.

In at least one embodiment, the frame buffer 104 comprises a plurality of buffer lines, each buffer line storing pixel data representative of a row of pixels of the image represented by the rasterized image data. The plurality of buffer lines may be logically arranged as a single column of buffer lines so that each buffer line represents pixel data for an entire row of pixels that spans the entire width of the image. Alternately, the plurality of buffer lines may be logically arranged as multiple columns of buffer lines so that each buffer line represents pixel data for a row of pixels that is a subset of an entire row of pixels that spans the entire width of the image. FIG. 2 depicts an example of a multiple-column buffer line arrangement where the buffer lines of the frame buffer 104 are logically arranged into four columns, so that each buffer line stores pixel data for one-fourth of the pixels of the width of the image stored in the frame buffer. In the illustrated example of FIG. 2, each buffer line stores pixel data representative of a row of eight pixels, resulting in a total width for the image as thirty-two pixels (it will be appreciated that in actual implementation the resolution of rasterized images typically will be much higher). For example, buffer line 132 (the first buffer line of the first column of frame buffer 104) stores pixel data for pixels (1,1)-(1,8) (identified by row, column) and buffer line 133 (the second buffer line of the first column) stores pixel data for pixels (2,1)-(2,8). The buffer frame 106, in one embodiment, is similarly configured to be accessed on a buffer line-by-buffer line basis.

In operation, the image rotation module 114 logically organizes the frame buffer 104 into a first matrix of pixel tiles, where each pixel tile represents an N×N block of pixels of the image represented by the stored rasterized image data. The number of pixels N, in one embodiment, is equal to the number of pixels represented by the pixel data at the buffer lines so that each pixel tile represents a column of N buffer lines. Similarly, the image rotation module 114 logically organizes the frame buffer 106 into a second matrix of pixel tiles representing N×N blocks of pixels, where the second matrix represents a rotation of the first matrix from its landscape orientation into a portrait orientation so that each pixel tile of the first matrix has a corresponding pixel tile of the second matrix in a corresponding rotated location of the frame buffer 106. The organization of the frame buffers 104 and 106 into matrices of pixel tiles is discussed in greater detail herein with respect to FIGS. 1 and 3-5.

To store a rotated copy of the rasterized image data stored at the frame buffer 104, in one embodiment, the image rotation module 114 individually rotates a copy of the pixel data for each selected pixel tile of the first matrix and stores the rotated pixel data at the buffer lines of the frame buffer 106 representing the pixel tile of the second matrix corresponding to the selected pixel tile. In one embodiment, a rotated copy of each of the first pixel tiles of the first matrix is written to the frame buffer 106 at frequent intervals or in response to an update event, such as a frame refresh or after a certain number of clock cycles or a certain amount of time has elapsed. Alternately, only those pixel tiles of the first matrix that have been modified since the last update of the frame buffer 106 have a rotated copy written to the frame buffer 106. To illustrate, in one embodiment, the dirty pixel tile table 120 includes a plurality of entries 122, each entry associated with a corresponding pixel tile of the first matrix. The dirty tile module 116 monitors the frame buffer 104 and when a write access occurs to pixel data represented by a particular pixel tile of the frame buffer 104, the dirty tile module 116 writes a value (e.g., a '1') to the corresponding entry to identify the corresponding pixel tile as "dirty" (i.e., having been modified). In response to an update event, the image rotation module 114 can access the dirty pixel tile table 120, either directly or via the dirty tile module 116, to identify those pixel tiles having modified data. The image rotation module 114 then rotates copies of the identified modified pixel tiles of frame buffer 104 and overwrites the corresponding pixel tiles of the frame buffer 106 with the rotated copies. An exemplary technique for rotating individual pixel tiles is described in detail herein with respect to FIGS. 1 and 3-5. An exemplary illustration of the image rotation module 114 is described in greater detail below with reference to FIG. 3.

Figure 3:
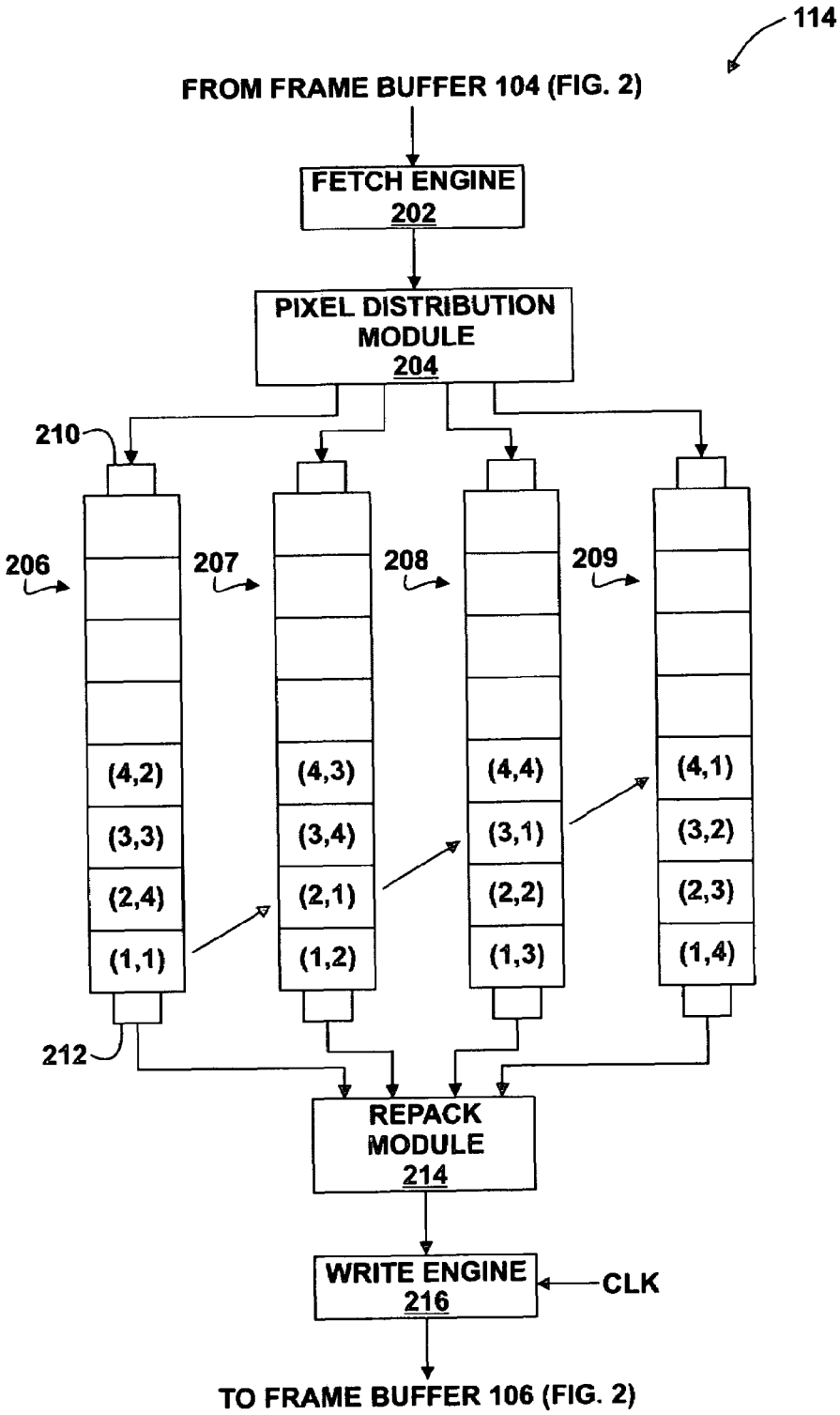
FIG. 3 is a block diagram illustrating an exemplary implementation of an image rotation module of the system of FIG. 2 in accordance with at least one embodiment of the present disclosure.

Referring to FIG. 3, an exemplary implementation of the image rotation module 114 is illustrated in accordance with at least one embodiment of the present disclosure. As shown, the image rotation module 114 includes a fetch engine 202 having an input connected to the frame buffer 104 (FIG. 2), a pixel distribution module having an input connected to an output of the fetch engine 202, a number M of tile buffers 206-209 (where M is four in the illustrated example), each having a write port 210 connected to a corresponding output of the pixel distribution module 204, a repack module 214 having input corresponding to a read port 212 of each of the M tile buffers 206-209, and a write engine 216 having an input connected to an output of the repack module 214 and an output connected to the frame buffer 106 (FIG. 2). The fetch engine 202 and/or the write engine 216 may be implemented as, for example, as direct memory access (DMA) controllers that access the frame buffers 316 via a bus or other connection. In one embodiment, the fetch engine 202 and the write engine 216 access the frame buffer 104 and the frame buffer 106, respectively, one buffer line at a time. The modules 204 and 214 may be implemented as hardware, software, firmware or a combination thereof.

In one embodiment, the tile buffers 206-209 include separately-accessible data storage components to store pixel data. Exemplary implementations of the tile buffers 206-209 include random access memory (RAM) components, flash memory components, groups of registers, and the like. Moreover, in at least one embodiment, the tile buffers 206-209 are dual-ported with a write port 210 and a read port 214 so that read accesses and write access may be performed concurrently. The tile buffers 206-209 each include a number of storage locations greater than or equal to the number of pixels represented by the pixel data stored at a buffer line, where each storage location is capable of storing the pixel data for at least one pixel. In certain instances, the display system 100 may be configured to support multiple pixel depths, such as an eight-bit pixel depth, a sixteen-bit pixel depth and a thirty-two-bit pixel depth. Accordingly, the tile buffers may be logically grouped together to form wider tile buffers. To illustrate, an exemplary implementation may require support for eight, sixteen and thirty-two bits per pixel with an internal bus width of sixty-four bits and a buffer line width of thirty-two bytes. In this example, up to eight pixels per clock may be received with up to thirty-two pixels per buffer line. Therefore, the tile buffers may be implemented as eight 8×32 tile buffers, or grouped as four 16×32 tile buffers or two 32×32 tile buffers.

In operation, the fetch engine 202 sequentially accesses each buffer line of a selected pixel tile of the matrix of pixel tiles representing the frame buffer 104 to obtain the pixel data stored at the accessed buffer line and provide the pixel data as output to the pixel distribution module. As discussed above, the pixel data at each buffer line represents a corresponding row of N pixels of the selected pixel tile. To illustrate, if each buffer line stores thirty-two bytes of data and each pixel has a pixel depth of one byte, each buffer line stores thirty-two pixels. As also discussed above, in one embodiment each pixel tile is a square matrix, so in the above-described example, the fetch engine 202 sequentially accesses the thirty-two buffer lines associated with the selected pixel tile before moving the next pixel tile.

Upon receipt of the pixel data from an accessed buffer line, the pixel distribution module 204 distributes the pixel data among the tile buffers 206-209 via their write ports 210 on a pixel-by-pixel basis. In one embodiment, the pixel distribution module 204 distributes the pixel data of each buffer line at the tile buffers 206-209 so that pixel data for each pixel of N column-adjacent pixels of the selected pixel tile is stored in a different tile buffer than the pixel data from other pixels of the N column-adjacent pixels of the selected pixel tile. As FIG. 3 illustrates, the distribution of pixel data may be accomplished by shifting the first tile buffer used to store pixel data by one position for each buffer line received. To illustrate using the example of FIG. 3, the pixel data of a first buffer line for pixels (1,1)-(1,4) is stored starting at tile buffer 206 for pixel (1,1) and ending at tile buffer 209 for pixel (1,4). For the adjacent buffer line having pixel data for pixels (2, 1)-(2,4), the pixel distribution module 204 shifts the starting tile buffer from tile buffer 206 to tile buffer 207 so that the pixel data for pixels (2,1)-(2,4) is stored starting at tile buffer 207 for pixel (2,1), then continuing to tile buffer 208 to store pixel (2,2) and to tile buffer 209 to store pixel (2,3). The pixel distribution module 204 then wraps around back to tile buffer 206 to store the last pixel (2,4) of the row of pixels. This shift-and-store process then continues for a third adjacent buffer line having pixel data for pixels (3,1)-(3,4) and a fourth adjacent buffer line having pixel data for pixels (4,1)-(4,4). At this point, a 4×4 pixel tile is stored in the tile buffers 206-209 so that each pixel of a set of four column-adjacent pixels is stored in different tile buffer. To illustrate, the four column-adjacent pixels (1,1)-(4,1) each are stored in a different tile buffer, the four column-adjacent pixels (1,2)-(4,2) each are stored in a different tile buffer, the four column-adjacent pixels (1,3)-(4, 3) each are stored in a different tile buffer, and the four column-adjacent pixels (1,4)-(4,4) each are stored in a different tile buffer.

The distribution of the pixel tiles so that N column-adjacent pixels each are stored in different tile buffers may be represented by the following pseudocode:

```
first_tile_buffer = 1        /* initialize first_tile_buffer to the first tile
                             buffer */
write_tile_buffer = 1        /* initialize write_tile_buffer to the first tile
                             buffer */
for i = 0 . . N {            /* for each of N buffer lines in the pixel tile */
    for k = 0 . . N {        /* for each of N pixel in each buffer line */
        write (buffer_line(k),          /* write the pixel data of pixel
        write_tile_buffer);               k of the buffer line to the tile
                                          buffer identified by
                                          write_tile_buffer */
        write_tile_buffer = (write_tile_buffer + 1)   /* select next tile
        modulo M                                        buffer */
    }  /* repeat for next pixel in buffer line */
    first_tile_buffer = (first_tile_buffer + 1)      /* shift starting tile
    modulo M                                           buffer for next buffer
                                                       line */
    write_tile_buffer =                /* set the next tile buffer to be
    first_tile_buffer                  written to as the starting tile
                                       buffer */
} /* repeat for next buffer line */
```

Although the process for determining the next tile buffer to write pixel data to is described above using pseudocode, in at least one embodiment the pixel distribution module 204 is implemented as hardware using combinational logic to perform the process outlined by the pseudocode described above.

The repack module 214, in one embodiment, accesses the M tile buffers 206-209 via their read ports 212 to obtain pixel data for each set of N column-adjacent pixels of the pixel tile and provides the obtained pixel data to the write engine 216, where the repack module 214 determines tile buffer location of each pixel of a set of N column-adjacent pixels based on the distribution process implemented by the pixel distribution module 204. Further, in at least one embodiment, the repack module 214 accesses the M tile buffers 206-209 substantially simultaneously in response to a clock signal CLK provided to the repack module 214, where the clock signal CLK may be the same as or different from a main clock signal of the display system 100 (FIG. 2).

It will be appreciated that each set of N column-adjacent pixels of the selected pixel tile of the first matrix obtained from the tile buffers 206-209 represents a corresponding row of N pixels for the rotated pixel tile of the second matrix of rotated pixel tiles represented in the frame buffer 106. Accordingly, the write engine 216 writes the pixel data representing each set of N column-adjacent pixels from the repack module 214 to its corresponding buffer line of the corresponding pixel tile of the frame buffer 106.

As described above, in one embodiment, the tile buffers 206-209 are dual-ported so as to allow the pixel distribution module 204 to write pixel data and the repack module 214 to read pixel data concurrently. Thus, the fetch engine 202 and pixel distribution module 204 can begin processing the next pixel tile for rotation before the repack module 214 and the write engine 216 have completed the rotation process for the previous pixel tile.

Figure 4:
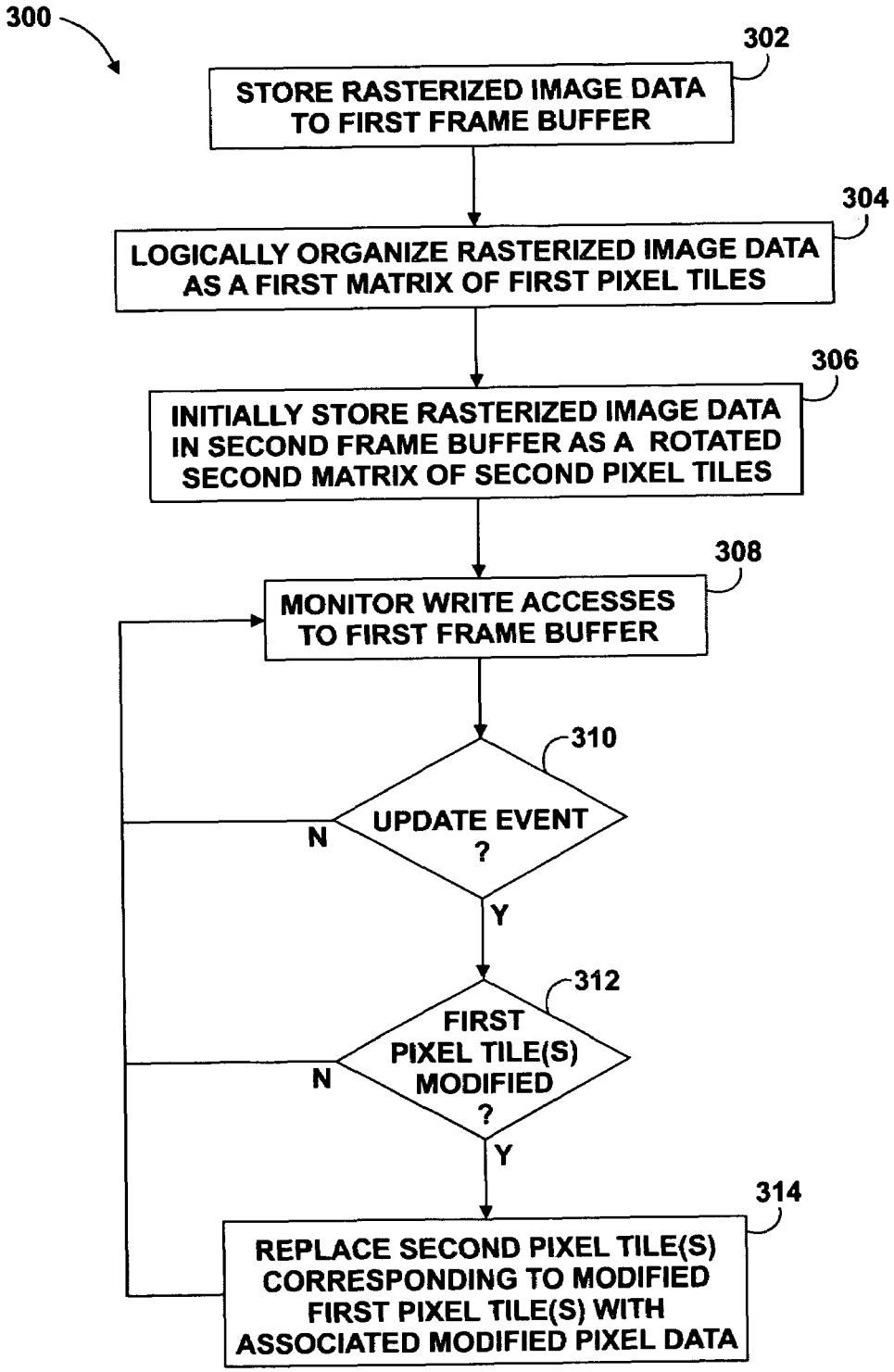
FIG. 4 is a flow diagram illustrating an exemplary method for rotating rasterized image data based on monitoring modifications to pixel tiles of a matrix of pixel tiles in accordance with at least one embodiment of the present disclosure.

Referring to FIG. 4, an exemplary method 300 for providing rasterized image data for an image in two orthogonal orientations is illustrated in accordance with at least one embodiment of the present disclosure. At block 302, rasterized image data is stored in a first frame buffer, where the rasterized image data is representative of an image in a first orientation, such as in a landscape orientation. At block 304, the rasterized data is logically organized as a first matrix of first pixel tiles, where the first matrix of first pixel tiles is representative of the image in the first orientation. Each first pixel tile includes a plurality of rows, each row having pixel data for a row of pixels of a corresponding portion of the image.

At block 306, a rotated copy of the rasterized image data initially is stored at a second frame buffer, where the rasterized image data at the second frame buffer is logically organized as a second matrix of second pixel tiles representative of the image in a second orientation orthogonal to the first orientation. Each second pixel tile of the second matrix includes an orthogonally-rotated representation of a corresponding first pixel tile of the first matrix. In at least one embodiment, the rasterized image data is rotated and copied to the second frame buffer on a pixel tile-by-pixel tile bases as described with reference to the image rotation module 114 of FIG. 3 and the exemplary pixel-tile rotation method 400 of FIG. 5.

At block 308, write accesses to the first frame buffer are monitored to identify one or more modified first pixel tiles having pixel data that has been modified since a first update event, where the first update event can include, for example, a frame refresh, a predetermined elapsed time or elapsed number of clock cycles, an interrupt, and the like.

In one embodiment, monitoring write accesses includes providing a modified tile table having a plurality of entries, each entry associated with a corresponding first pixel tile of the first matrix. In response to a write access to rasterized image data of a first pixel tile, the value of the entry associated with the first pixel tile is modified and first pixel tiles of the first matrix therefore may be determined to be modified based on the value at their corresponding entries of the modified tile table.

When a second update event is detected at block 310, it is determined whether any of the first pixel tiles have modified data based on the monitoring of the write accesses. If a first pixel tile is identified as having modified pixel data, at block 310 the rasterized image data of the second pixel tile at the second frame buffer corresponding to the identified first pixel tile is replaced with the rasterized image data of the identified first pixel tile in response to the second update event, where the rasterized image data of the identified first pixel tile is orthogonally rotated to replace the rasterized image data of the corresponding pixel tile. The replacement process of block 310 is performed for each first pixel tile identified as having modified pixel data. The method 300 then returns to block 308 to identify any further modifications to the rasterized image data in the first frame buffer.

Figure 5:
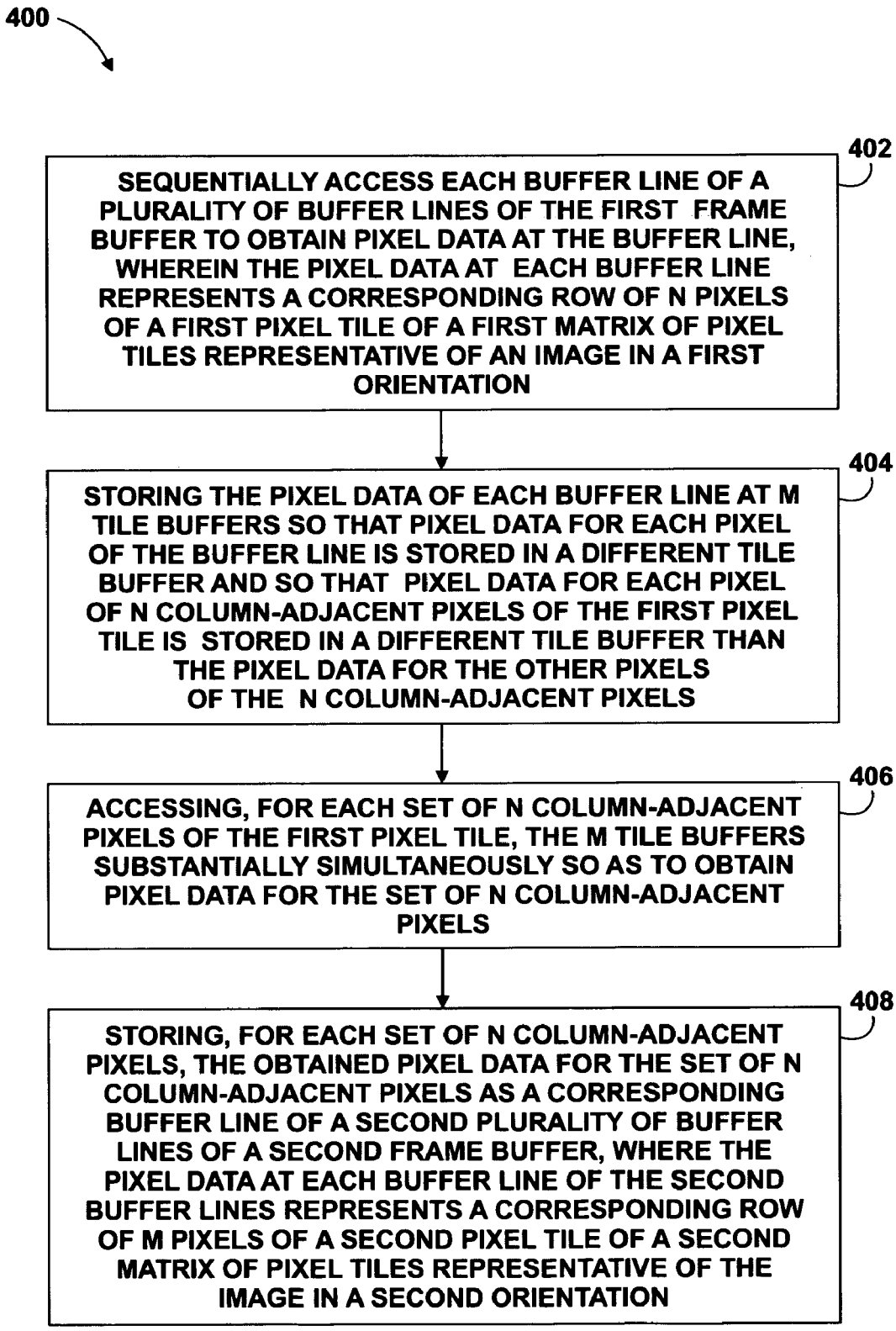
FIG. 5 is a flow diagram illustrating an exemplary method for rotating a pixel tile in accordance with at least one embodiment of the present disclosure.

Referring to FIG. 5, an exemplary method 400 for rotating a pixel tile is illustrated in accordance with at least one embodiment of the present disclosure. At block 402, each buffer line of a plurality of buffer lines of a first frame buffer is accessed to obtain pixel data at the buffer line. The pixel data at each buffer line represents a corresponding row of N pixels of a first pixel tile of a first matrix of pixel tiles representative of an image in a first orientation.

At block 404, the pixel data of each buffer line is stored at M separately-accessible tile buffers so that pixel data for each pixel of the buffer line is stored in a different tile buffer and so that pixel data for each pixel of N column-adjacent pixels of the first pixel tile is stored in a different tile buffer than the pixel data for the other pixels of the N column-adjacent pixels. In at least one embodiment, M is greater than or equal to N.

At block 406, the M tile buffers are access substantially simultaneously for each set of N column-adjacent pixels so as to obtain pixel data for the set of N column-adjacent pixels. At block 408, the obtained pixel data for each set of N column-adjacent pixels is stored as a corresponding buffer line of a second plurality of buffer lines of a second frame buffer. The pixel data at each buffer line of the second plurality of buffer lines represents a corresponding row of N pixels of a second pixel tile of a second matrix of tiles representative of the image in a second orientation orthogonal to the first orientation.

Other embodiments, uses, and advantages of the disclosure will be apparent to those skilled in the art from consideration of the specification and practice of the disclosure disclosed herein. The specification and drawings should be considered exemplary only, and the scope of the disclosure is accordingly intended to be limited only by the following claims and equivalents thereof.

What is claimed is:

1. A method comprising:

sequentially accessing each buffer line of a first plurality of buffer lines of a first frame buffer having rasterized image data to obtain pixel data at the buffer line, wherein the pixel data at each buffer line of the first plurality of buffer lines represents a corresponding row of N pixels of a first pixel tile of a first matrix of pixel tiles representative of an image in a first orientation;

storing the pixel data of each buffer line at M separately-accessible tile buffers so that pixel data for each pixel of the buffer line is stored in a different tile buffer and so that pixel data for each pixel of N column-adjacent pixels of the first pixel tile is stored in a different tile buffer than the pixel data for the other pixels of the N column-adjacent pixels, wherein M is greater than or equal to N;

accessing, for each set of N column-adjacent pixels of the first pixel tile, the M tile buffers substantially simultaneously so as to obtain pixel data for the set of N column-adjacent pixels; and storing, for each set of N column-adjacent pixels, the obtained pixel data for the set of N column-adjacent pixels as a corresponding buffer line of a second plurality of buffer lines of a second frame buffer, wherein the pixel data at each buffer line of the second plurality of buffer lines represents a corresponding row of N pixels of a second pixel tile of a second matrix of pixel tiles representative of the image in a second orientation orthogonal to the first orientation.

2. The method of claim 1, wherein the M tile buffers comprise dual-ported buffers capable of substantially simultaneous read access and write access.

3. The method of claim 2, wherein storing the pixel data and accessing the M tile buffers occurs substantially simultaneously.

4. The method of claim 1, wherein the first frame buffer and the second frame buffer comprise the same frame buffer.

5. The method of claim 1, wherein the first orientation comprises a horizontal orientation.

6. The method of claim 1, wherein the pixel data of the first plurality of buffer lines of the first frame buffer is transferred to the second plurality of buffer lines of the second frame buffer when a write access has occurred to the first plurality of buffer lines.

7. The method of claim 6, further comprising determining whether a write access has occurred to the first plurality of buffer lines.

8. A method comprising:

logically organizing rasterized image data stored at a first frame buffer as a first matrix of first pixel tiles, wherein the first matrix of first pixel tiles is representative of an image in a first orientation and wherein each first pixel tile comprises a plurality of rows, each row comprising pixel data for a row of pixels of a corresponding portion of the image;

storing the rasterized image data at a second frame buffer, wherein the rasterized image data at the second frame buffer is logically organized as a second matrix of second pixel tiles representative of the image in a second orientation orthogonal to the first orientation, wherein each second pixel tile of the second matrix comprises an orthogonally-rotated representation of a corresponding first pixel tile of the first matrix;

monitoring write accesses made to the first frame buffer to identify one or more modified first pixel tiles comprising pixel data that has been modified since a first update event by:

providing a modified tile table having a plurality of entries, each entry associated with a corresponding first pixel tile of the first matrix of first pixel tiles;

in response to a write access to rasterized image data of a first pixel tile, modifying a value of an entry associated with the first pixel tile; and determining a first pixel tile as modified based on a value of its corresponding entry of the modified tile table; and replacing, for each modified first pixel tile of the one or more modified first pixel tiles, the rasterized image data of the corresponding second pixel tile at the second frame buffer with the rasterized image data of the modified first pixel tile in response to a second update event, wherein the rasterized image data of the modified first pixel tile is orthogonally rotated to replace the rasterized image data of the corresponding second pixel tile.

9. The method of claim 8, wherein the first frame buffer and the second frame buffer comprise a same frame buffer.

10. The method of claim 8, wherein the first pixel tiles and the second pixel tiles represent square matrices of pixels.

11. The method of claim 8, wherein replacing the rasterized image data comprises:

sequentially accessing each buffer line of a first plurality of buffer lines of the first frame buffer corresponding to the modified first pixel tile, wherein the pixel data at each buffer line of the first plurality of buffer lines represents a corresponding row of N pixels of the modified first pixel tile;

storing the pixel data of each buffer line at M separately-accessible tile buffers so that pixel data for each pixel of the buffer line is stored in a different tile buffer and so that pixel data for each pixel of N column-adjacent pixels of the modified first pixel tile is stored in a different tile buffer than the pixel data for the other pixels of the N column-adjacent pixels, wherein M is greater than or equal to N;

accessing, for each set of N column-adjacent pixels of the first pixel tile, the M tile buffers substantially simultaneously so as to obtain pixel data for the set of N column-adjacent pixels; and storing, for each set of N column-adjacent pixels, the obtained pixel data for the set of N column-adjacent pixels as a corresponding buffer line of a second plurality of buffer lines of the second frame buffer associated with the second pixel tile that corresponds to the modified first pixel tile, wherein the pixel data at each buffer line of the second plurality of buffer lines represents a corresponding row of N pixels of the second pixel tile.

12. The method of claim 8, wherein the first and second update events comprise frame refreshes.

13. A system comprising:

a first frame buffer to store rasterized image data in a first orientation;

a second frame buffer to store rasterized image data in a second orientation orthogonal to the first orientation;

M separately-accessible tile buffers;

a fetch engine operably coupled to the first frame buffer, the fetch engine to sequentially access each buffer line of a first plurality of buffer lines of the first frame buffer to obtain pixel data at the buffer line, wherein the pixel data at each buffer line of the first plurality of buffer lines represents a corresponding row of N pixels of a first pixel tile of a first matrix of pixel tiles representative of an image in the first orientation;

a pixel distribution module operably coupled to the fetch engine and the M tile buffers, the pixel distribution module to store the pixel data of each buffer line at the M tile buffers so that pixel data for each pixel of the buffer line is stored in a different tile buffer and so that pixel data for each pixel of N column-adjacent pixels of the first pixel tile is stored in a different tile buffer than the pixel data for the other pixels of the N column-adjacent pixels, wherein M is greater than or equal to N;

a repack module operably coupled to the M tile buffers, the repack module to access, for each set of N column-adjacent pixels of the first pixel tile, the M tile buffers substantially simultaneously so as to obtain pixel data for the set of N column-adjacent pixels; and a write engine operably coupled to the repack module and the second frame buffer, the write engine to store, for each set of N column-adjacent pixels, the obtained pixel data for the set of N column-adjacent pixels as a corresponding buffer line of a second plurality of buffer lines of the second frame buffer, wherein the pixel data at each buffer line of the second plurality of buffer lines represents a corresponding row of N pixels of a second pixel tile of a second matrix of pixel tiles representative of the image in the second orientation.

14. The system of claim 13, wherein the M tile buffers comprise dual-ported buffers capable of substantially simultaneous read access and write access.

15. The system of claim 14, wherein the pixel distribution module stores the pixel data and the repack module accesses the M tile buffers substantially simultaneously.

16. The system of claim 13, wherein the first frame buffer and the second frame buffer comprise the same frame buffer.

17. The system of claim 13, wherein the first orientation comprises a horizontal orientation.

18. The system of claim 13, further comprising:

a modified tile module operably coupled to the first frame buffer, the modified tile module to:

provide a modified tile table having a plurality of entries, each entry associated with a corresponding first pixel tile of the first matrix of first pixel tiles; and in response to a write access to rasterized image data of a first pixel tile, modify a value of an entry associated with the first pixel tile; and wherein the pixel data of the first plurality of buffer lines of the first frame buffer is transferred to the second plurality of buffer lines of the second frame buffer when a write access has occurred to the first plurality of buffer lines.

* * * * *